US005730299A

United States Patent [19]

Helsley

[11] Patent Number: 5,730,299

[45] Date of Patent: Mar. 24, 1998

[54] AUTOMATED INSERT VERIFICATION FOR INSERTING MACHINE AND METHOD

[75] Inventor: Thomas H. Helsley, Coppell, Tex.

[73] Assignee: Automated Mailing Systems Corp., Dallas, Tex.

[21] Appl. No.: 565,219

[22] Filed: Nov. 30, 1995

[51] Int. Cl.[6] ..... B07C 5/00

[52] U.S. Cl. ..... 209/584; 209/579

[58] Field of Search ..... 209/583, 584, 209/579, 577, 547, 569; 53/396

[56] References Cited

U.S. PATENT DOCUMENTS 5,287,976 2/1994 Mayer et al. ..... 209/584

5,421,464 6/1995 Gillmann et al. ..... 209/584

*Primary Examiner*—Kenneth Noland

*Attorney, Agent, or Firm*—Crutsinger & Booth

[57] ABSTRACT

An automation and verification device for an insert machine which assembles stacks of inserts. The inserts are located in electronically selectable hoppers and are encoded with an electronically readable sort code. The automation and verification device has a controller unit, a first code scanner and a second code scanner, and a program executed on the controller unit. The controller unit has a microprocessor and an electronic memory circuit. The controller unit is electrically connected to the insert machine such that the electronically selectable hoppers can be controlled by the controller unit. The first and the second code scanners are mounted on the insert machine such that the scanners are oriented to read the sort code on the inserts. The code read by the first scanner is interpreted by the program which responds by designating a job set of hoppers for inserts to be taken from. When the job set encounters the second code scanner, the code read is verified against a value stored in a table located in the electronic memory circuit. In a further aspect of the invention, if an error occurs, the insert job is halted so the error may be corrected and continued after the error is corrected.

19 Claims, 7 Drawing Sheets

132

| SORT CODE | HOPPER 1 | HOPPER 2 | HOPPER 3 | HOPPER 4 |
|---|---|---|---|---|
| 28 | Y | Y | N | N |
| 32 | Y | Y | Y | N |
| 41 | Y | Y | N | Y |
| 00 | Y | Y | Y | Y |
| 24 | Y | N | N | N |
| 78 | Y | N | N | N |
| 65 | Y | N | N | Y |

130 130 130 130 130 130 130

134 134 134 134 134 134 134

138

Fig. 8

AUTOMATED INSERT VERIFICATION FOR INSERTING MACHINE AND METHOD

TECHNICAL FIELD

This invention relates to the automation of an insert machine which assembles mailing packages of insert material. More particularly, the present invention relates to the automation of insert machine hopper selections according to an initial code on an insert and verification of insert materials according to the initial code.

BACKGROUND OF THE INVENTION

Insert machines for stuffing envelopes for bulk mail processes, such as accounts billing, promotional advertisement campaigns, are routinely used to indiscriminately saturate designated market regions. However, cost conscious marketing departments began incorporating demographic information in bulk mailings to focus on consumer characteristics in a particular postal region or discrete zip code area. Typically, the demographic information is used to disseminate a mailing list into a series of target groups according to categories such as purchasing habits, income level, or hobbies and interests. Therefore, a need exists for apparatus that could provide a mass mailing of promotional materials targeted for these groups with a core letter or accounts bill.

Presently, insert machines exist which have a plurality of hoppers which contain mailing inserts. Manual toggle switches are used to activate or to deactivate each hopper according to the demographic information. For example, a mailing sent to golfers would contain advertisements or offers which pertain to golfing equipment in addition to a general core letter or account billing. The advantage of such an operation is that the advertisements are sent exclusively to those who might have an interest in golf, saving materials and costs to the advertiser incurred by an indiscriminate bulk mailings. However, such an operation is tedious. Before each mailing insert operation can be performed, the inserting machine must be reconfigured for that particular advertisement run, adding labor costs to the operation. Furthermore, there is no automated verification process to ensure that the correct advertisements are inserted for the correct demographic group. When such errors occur, lost opportunity for a sale results and the overall profitability is adversely impacted of the advertising operation.

Therefore, it is desirable to limit the amount of labor costs and misplaced advertisements by automating the hopper selections and by verifying that the proper materials are being placed within the envelopes designated for the target group.

SUMMARY OF THE INVENTION

An automation and verification device for an insert machine which assembles stacks of inserts. The inserts are located in electronically selectable hoppers and are encoded with an electronically readable sort code. The automation and verification device has a controller unit, a first code scanner and a second code scanner, and a program executed on the controller unit. The controller unit has a microprocessor and an electronic memory circuit. The controller unit is electrically connected to the insert machine such that the electronically selectable hoppers can be controlled by the controller unit. The first and the second code scanners are mounted on the insert machine such that the scanners are oriented to read the sort code on the inserts. The code read by the first scanner is interpreted by the program which responds by designating a job set of hoppers for inserts to be taken from. When the job set encounters the second code scanner, the code read is verified against a value stored in a table located in the electronic memory circuit. In a further aspect of the invention, if an error occurs, the insert job is halted so the error may be corrected and continued after the error is corrected.

A further aspect of the invention is a method for automating an insert job. An insert stack set is provided which has at least a first stack with a first plurality of inserts and a second stack with a second plurality of inserts. The first stack has an first electronically readable key code encoded on each of its inserts. The key code has at least a first sort code value of a second sort code value. The first key code on an insert of the first is scanned. A program executed on a microprocessor determines whether the first key code has either the first sort code value of the second sort code value. From the insert stack set, a predetermined job set is designated according to the first sort code value or said second sort code value with an electronic selection circuit controllable by the program executed on the microprocessor. A job stack is formed with an insert from each stack of the predetermined job set. The job stack is inserted into a mailing envelope.

These and other features and advantages of the present invention will be apparent to those skilled in the art upon reading the following detailed description of preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which:

FIG. 8 is a table illustrating hopper designations based on a sort code value.

DESCRIPTION OF THE PREFERRED EMBODIMENT

Figure 1:
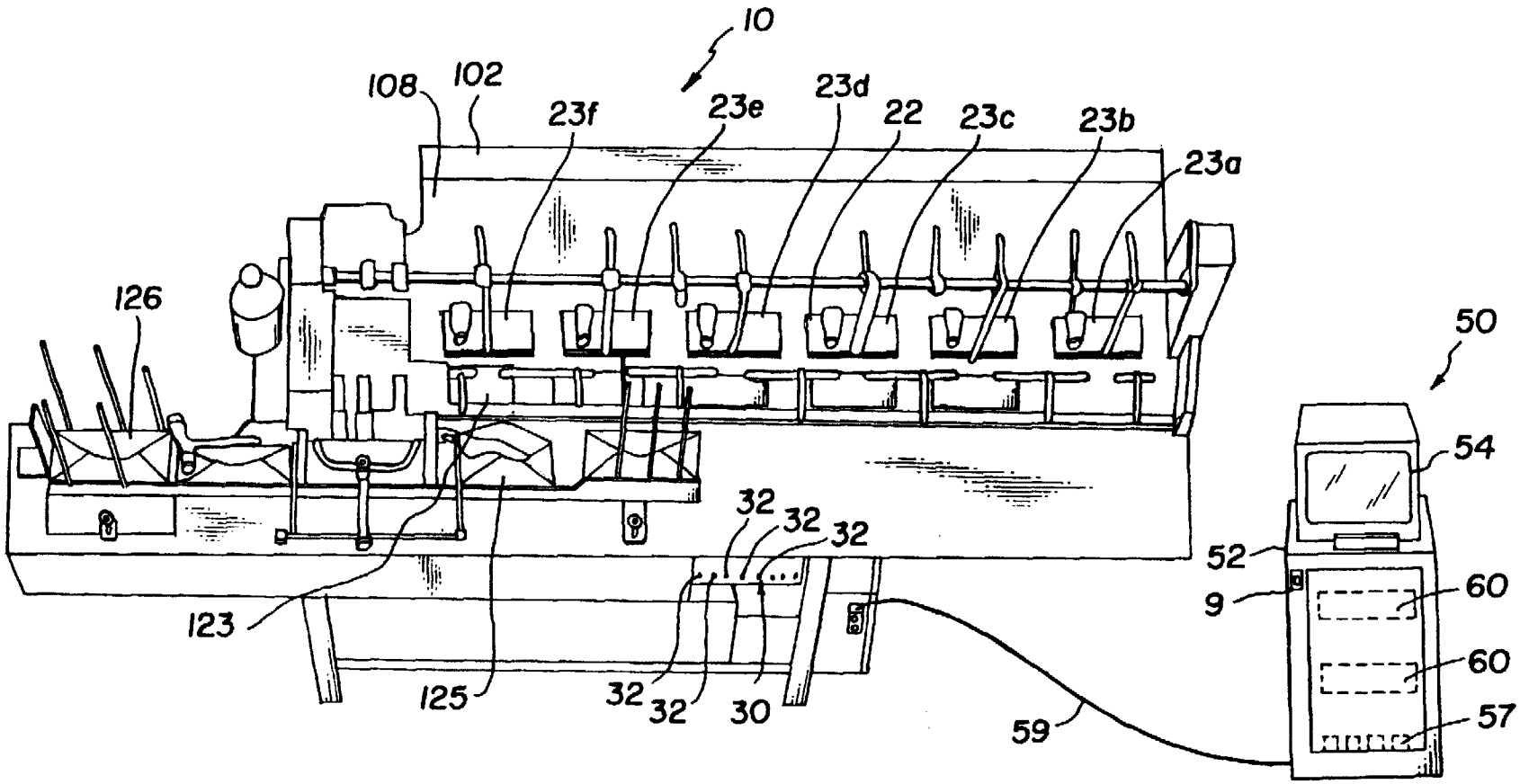
FIG. 1 is a perspective view of the automation and verification device of the present invention connected to an insert machine.

Referring now to the drawing where like reference characters are used throughout the figures to refer to like parts, there is shown in FIG. 1 an insert machine generally designated by the numeral 10, which gathers insert materials such as account billings or promotional materials 22 into neat, orderly piles or stacks. As discussed later in detail, these stacks are inserted into envelopes which are sealed and mailing postage is applied. A suitable insert machine is an "Imperial 10,000 Inserter Model A340" available from the Bell & Howell Company. Rebuilt insert machines are available from AMSCO of Dallas, Tex.

Shown in FIG. 1, insert machine 10 has a plurality of insert stations or hoppers 20 into which billing statements or promotional inserts 22 are placed. The insert machine 10 shown as an example has six hoppers, but other models are available with fifteen hoppers. The individual hoppers 20 are conventionally armed or activated by insert machine control panel 30 which has a plurality of toggle switches 32. Each switch 32 selects between an "on" or "off" status which corresponds to each hopper 20.

Referring to FIG. 1, attached to the insert machine 10 is an automation and verification device 50. Automation and verification device 50 comprises a microprocessor-based controller unit 52 having a keypad 53, a video display monitor 54, a hopper selector interface circuit 56 provided by a plurality of relays 57, scanners 58 and scanner decoder 60 to read and decode the data read by the scanners 58.

Figure 2:
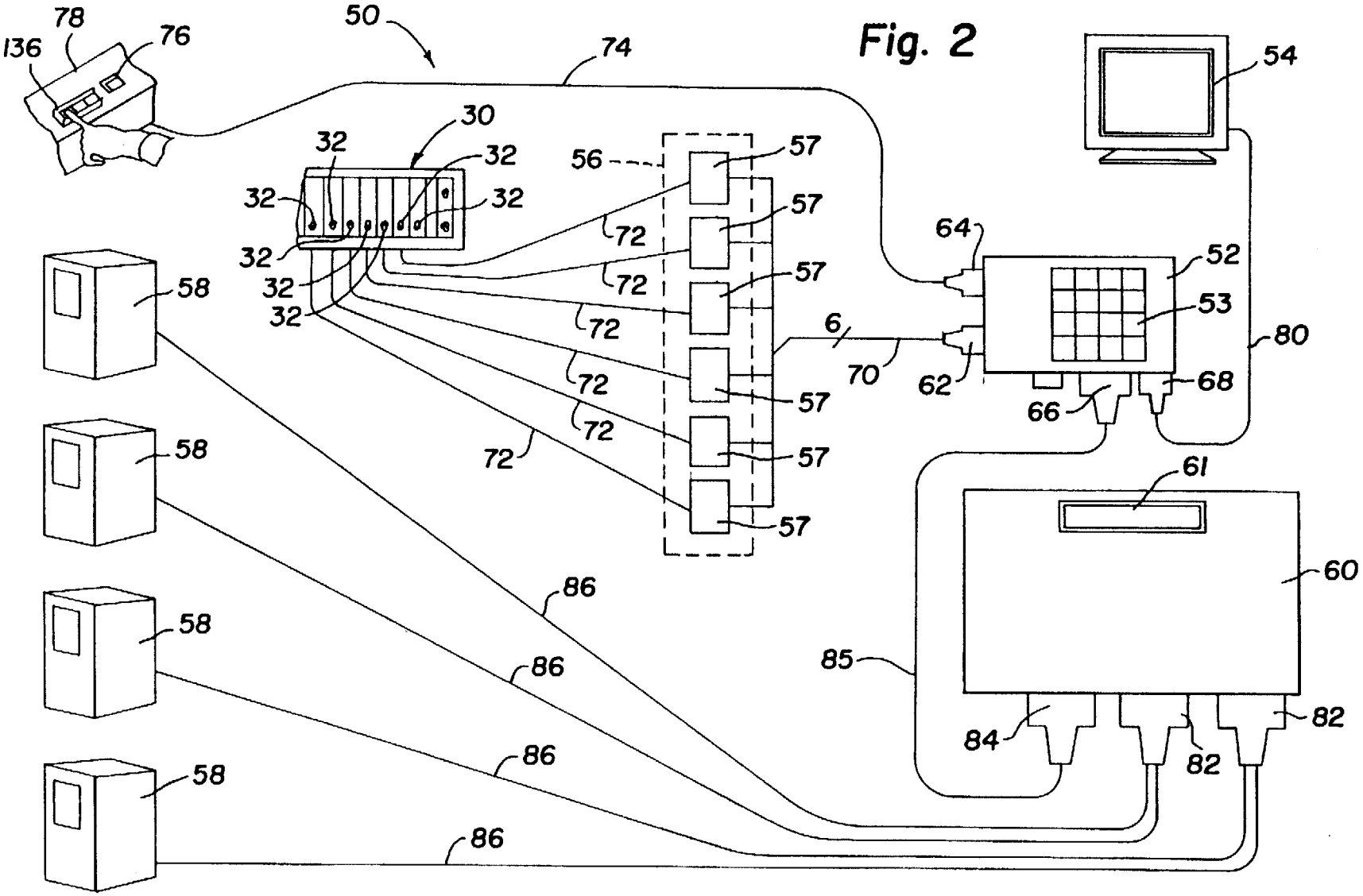
FIG. 2 is a diagram of the components of the automation and verification device of the present invention.

Referring to FIG. 2, automation and verification device 50 is illustrated in greater detail. Controller unit 52 has a direct current ("DC") or digital output port 62, a DC or digital input port 64, bar code input port 66 and video monitor port 68. A suitable controller unit 52 is a Scanstar model 225 bar code terminal, available from Computer Identics Corporation and described in detail in the "Scanstar 225/325/326 User's Guide," Pub. No. EM-66800-2 (2d Ed.). Digital output port 62 of controller unit 52 has a fifteen-socket connector configuration which is connected through a plurality of conductors 70 to relays 57. Relays 57 are connected through a second plurality of conductors 72 to insert machine control panel 30. Relays 57 provide electrical decoupling of the controller unit 52 from control panel 30. Other suitable electrical schemes could accomplish the same decoupling effect of the controller unit 52 from control panel 30 such as a digital multiplexer with conductors routed through a high impedance amplifier. Relays 57 are connected to insert machine control panel such that relays 57 override the conventional toggle switch 32 connections for designating the hoppers 20 manually. Table 1 illustrates the relationship between relays 57 and hoppers 20*a*, 20*b*, 20*c*, 20*d*, 20*e* and 20*f* as follows:

TABLE 1

| Pin | Description |
|---|---|
| 1 | Relay 1 (hopper 1) |
| 2 | Relay 2 (hopper 2) |
| 3 | Relay 3 (hopper 3) |
| 4 | Relay 4 (hopper 4) |
| 5 | Relay 5 (hopper 5) |
| 6 | Relay 6 (hopper 6) |
| 7 | Relay 7 (hopper 7) |
| 8 | Relay 8 (hopper 8) |

Digital input port 64 is connected through a conductor designated as halt signal line to continue job button 76 of user job panel 78. Digital input port 64 of controller unit 52 has a fifteen-socket connector configuration. Video display monitor 54 is connected to control terminal 52 through video cable 80. A suitable video display monitor is available from Pro America Corporation. The video display monitor may be a simple monochrome monitor, but color monitors can be used if color graphics are desired and implemented in the software which is executed on the microprocessor-based controller unit 52.

Connected to the controller unit 52 is scanner decoder 60 having scanner ports 82 and controller unit port 84. A suitable scanner decoder 60 is a model Scanstar 242 available from Computer Identics Corporation.

Figure 3:
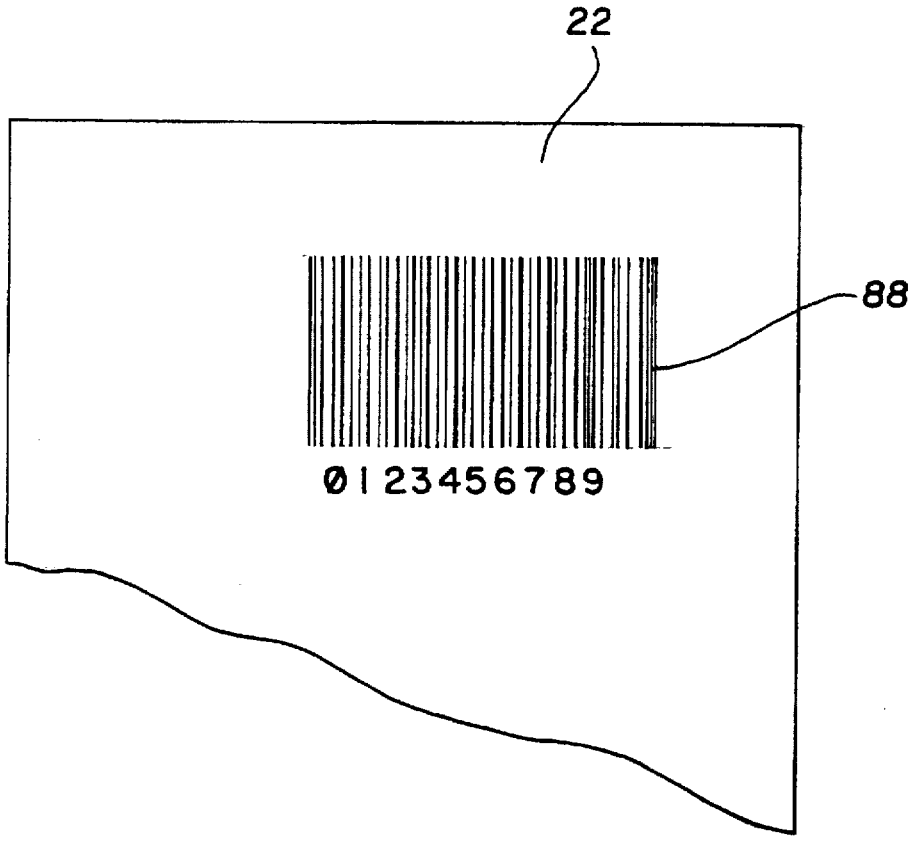
FIG. 3 is an illustration of an insert with a computer readable code.

Scanners 58 are connected through conductors 86 to scanner ports 82. Scanners 58 illuminate code labels, such as bar code labels, using a low-power, visible-red laser diode. A suitable scanner is model "10SR Laser Diode Scanner" available from Computer Identics Corporation. This model of scanner is designed for industrial environments such as warehouses, shop floors, and laboratories. Scanners 58 read the scanner codes 88 shown in FIG. 3 by the waveform pattern caused by laser-light reflected from scanner code 88. Scanners 58 digitize the waveform patterns and send the digitized waveforms to the scanner decoder 60 scanner ports 68 through scanner cables 86. Scanner decoder 60 analyzes and decodes the label data which is then conveyed to the microcontroller 52. Activity of the decoder 60 is indicated through scanner display 61. Scanner decoder 60 and scanners 58 are described in detail in the "Scanstar 10/15SR and Scanstar 242 Technical Reference Manual," Pub. No. EM-62420-1.

Figure 4:
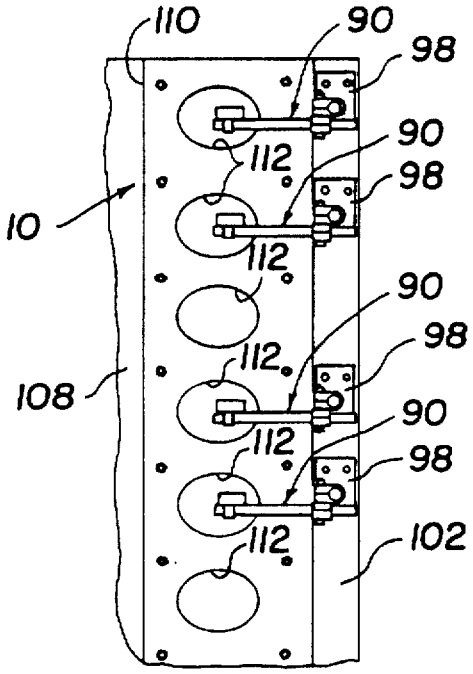
FIG. 4 is a side plan view of a scanner placement arm with a scanner attached and a stack of inserts on the insert machine.

Referring to FIG. 4, shown is a scanner 58 mounted on insert machine 10 by scanner placement arm 90. For clarity, mechanical portions of insert machine 10 has been removed. Scanner placement arm 90 is preferably made of a material that is resistant to exposure to hostile environments such as factories or laboratories, such as galvanized steel. Scanner placement arm 90 has a first elongated member 92, a second elongated member 94, a pivot mount 96, and a flange base 98. First elongated member 92 and second elongated member 94 have a substantially circular cross-section. Flange base 86 is attached to first end 100 of first elongated member 92 through welding or other attachment methods. Flange base 98 is mounted to support plate 102 with bolts 104 extending through apertures which are threadingly engaged by nuts 106 or with other mounting methods. Support plate 102 is attached to hopper plate 108 of insert machine 10 with bolts 104 extending through apertures which are threadingly engaged by nuts 106 or with other mounting methods. Support plate 102 extends past edge 110 of hopper plate 108 to allow placement arm 90 onto insert machine 10 and to allow proper positioning of scanner 58. In FIG. 4, scanner 58 is positioned to access an underside of a stack of inserts 22, which have scanner codes 88, through support plate aperture 112. Support plate aperture 112 is of a size sufficient to allow scanner 58 to access that surface of an insert having dimensions of about 8.5 inches by about 11 inches. These inserts are encoded with a scanner code 88 shown in FIG. 3. In other models of insert machines, support plate 102 may not be necessary for mounting scanner placement arm 90 to the insert machine.

Figure 5:
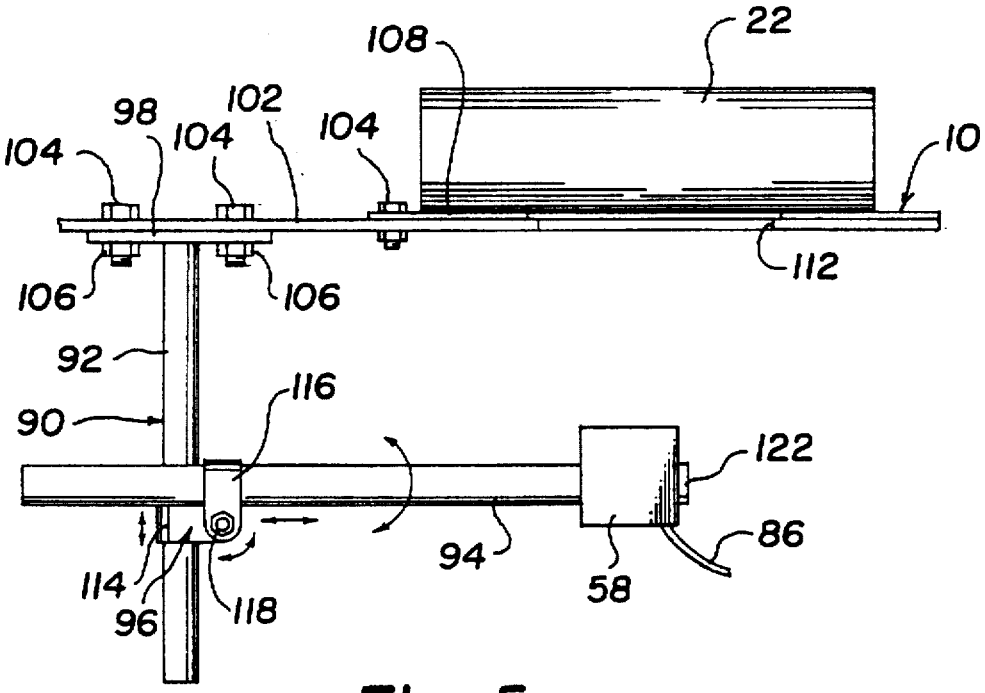
FIG. 5 is a rear plan view of a scanner placement arm with a scanner attached.

As shown in FIG. 4, when mounted to support plate 82, first elongated member 92 extends in a substantially vertical direction with respect to support plate 82. First bracket portion 114 of pivot mount 96 is generally U-shaped to substantially surround the surface of first elongated member 92. As best illustrated in FIG. 5, second bracket portion 116 of pivot mount 96 is also generally U-shaped to substantially surround the surface of second elongated member 94. First portion 114 and second portion 116 are interconnected by a nut 118 threadingly engaged on bolt 120. Attached near a first end 122 is scanner 58 which is attached to second elongated member 94 with strap 124.

Scanner placement arm 80 allows three-dimensional adjustment of scanner 58 for ready adjustment to enable scanner 58 to read scanner code 104 on inserts 22. Second elongated member 94 may be adjusted along its longitudinal and its moment axes through second portion 116. The vertical displacement of scanner 58 with respect to support plate 102 can be adjusted by sliding first portion 114 along the length of first elongated member 92 as well as rotating first portion 114 around the surface of first elongated member 92. When scanner 58 is in proper alignment to scan codes on inserts 22, nut 188 is tightened to engage first bracket portion 90 and the second bracket portion 92 into a compressed, frictional relation with each other and with first and second elongated members 92 and 94, respectively, thereby causing scanner placement arm 90 to maintain a fixed position.

Figure 6:
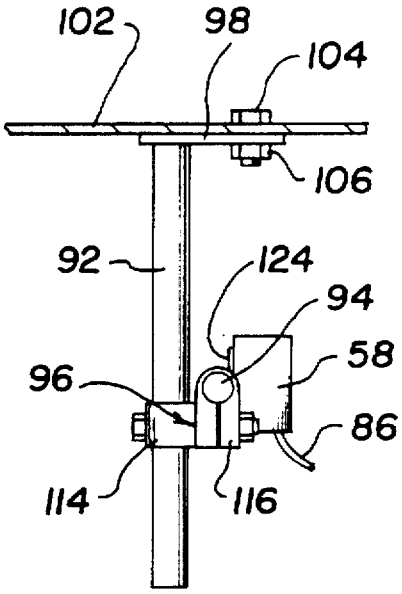
FIG. 6 is plan viewed from the below with scanner placement arms with scanners attached.

Referring to FIG. 6, shown is scanners 58 positioned to read scanner codes 88 on inserts 22.

Figure 7:
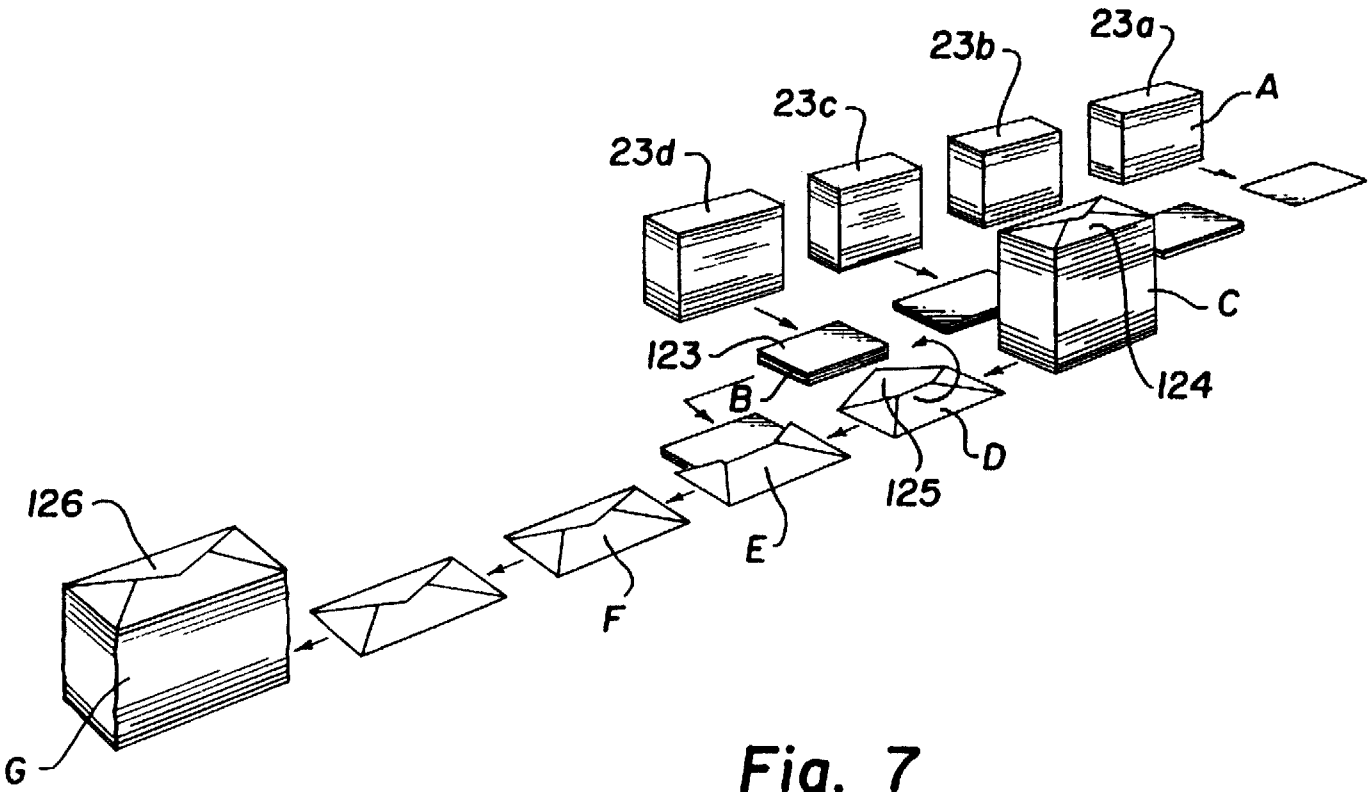
FIG. 7 is an illustration of an insert job with the insert machine removed.

Referring to FIG. 7, shown is an insertion job with insert machine 10 removed to better illustrate the insertion process or job. An insert stack set is shown with four stacks 23*a*, 23*b*, 23*c* and 23*d*. Each stack has a plurality of inserts 22. First stack 23*a* has an electronically readable key code encoded on each insert 22. The key code will have at least a first sort code value or a second sort code value. These sort code values indicate which hoppers will be active for insertion of market specific inserts, such as golf advertisements or scuba gear advertisements, for example. Scanner code 88 on a first insert of stack 23*a* is scanned or read (step A). For example, referring to FIG. 8, shown is a table indicating which hoppers to activate for the insertion process. For this example, if the sort code value retrieved is "28," then inserts from stacks 23*a* and 23*b* shown in FIG. 7 would be designated. A stack of inserts 123 is assembled from inserts of stacks 23*a* and 23*b* (step B). Envelopes 124 are positioned as a stack as shown in FIG. 7 (step C). Envelopes 124 are mechanically placed to correspond with the placement of stack 123 and envelope flaps 125 are opened (step D). An assembled stack of inserts 123 are inserted into the envelope 124 (step E). Envelope flap 125 is moistened, closed and sealed (step F). Sealed envelope 28 is then stacked to form stack 126 (step G).

An insert job typically comprises a core mailing package, such as an account billing, which would be represented by stack 23*a* shown in FIG. 7 and additional promotional inserts 22 according to demographic information relating to the mailing recipient database. Generally, the advertisement or billing inserts, which would be typically placed in stacks 23*b*, 23*c* and 23*d* shown in FIG. 7, are separated into such stacks according to their subject matter, such as golf or scuba diving, and assigned a sort code value 130. Referring to FIG. 8, for example, if the sort code value was "65," then inserts from stacks 23*a* and 23*d* shown in FIG. 7 would be used in the insert job to form a job stack 123. Therefore, the core mailing stack 23*a* establishes an insert sort code value 130 which dictates the predetermined job set according to the sort code value of the first key code found in stack 23*a*.

FIG. 8 shows a table 132 with a first column containing sort code values 130. When the apparatus is in operation, this table is displayed on video display monitor 54 shown in FIG. 2. Rows represent predetermined job sets 134. With respect to the sort code values 130, the stacks 23*a* through 23*d* designated to be placed in a job stack 123 as represented by the alphanumeric symbol "Y" or "N," accordingly. Conventionally, an operator would designate different stacks among different mailing job sets according to a data sheet and manually configure insert machine 10 by setting toggle switches 32, shown in FIG. 2. The method disclosed herein automates the process, thereby limiting the potential for human error and labor costs.

Figure 9:
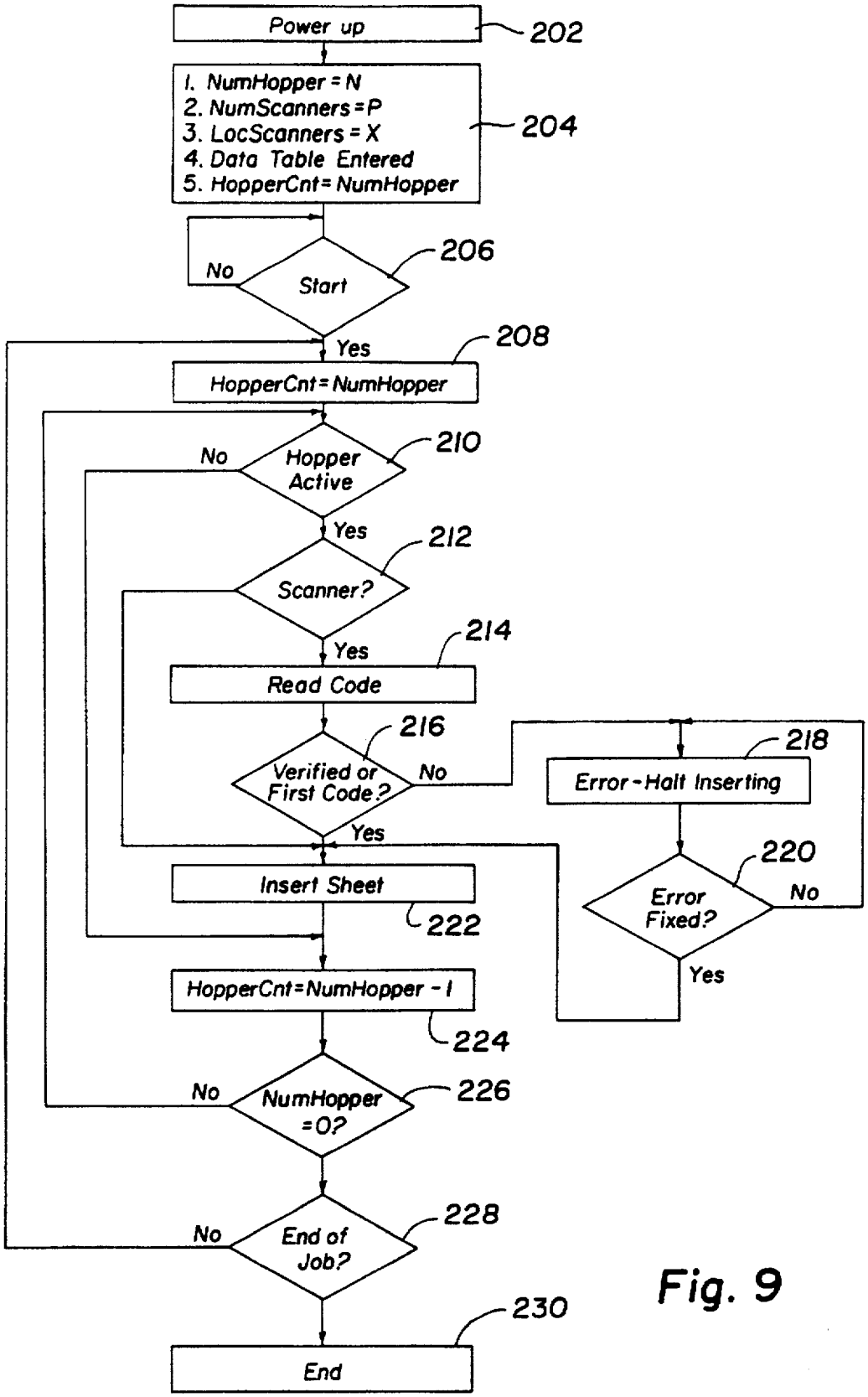
FIG. 9 is a software flow chart of the method of the invention.

Shown in FIG. 9 is a flow chart. Software executed on the microprocessor of controller unit 52 performs the steps shown. Once insert machine 10 is loaded with insert stacks 23*a*, 23*b*, 23*c* and 23*d*, AVD 50 and insert machine 10 are powered-up (step 202) by pressing power switch 136, shown in FIG. 2. Through keypad 53, the operator verifies the table 132 shown in FIG. 8 and is prompted by the software to enter other information necessary for the program to function (step 204) such as the number of hoppers which is stored in variable NumHoppers, number of scanners which is stored in variable NumScanners, and the location of the scanners at the hoppers which is stored in the variable LocScanners. The operator starts insert machine 10 (step 206) by responding to the software's prompt to begin displayed on video display monitor 54. HopperCnt is set initially to equal the value stored in the NumHopper variable (step 208). Typically, the number of hoppers is six, but can be any number allowed by the inserting machine 10 and the available electronic hardware configurations. For this example to coincide with the insert job depicted in FIG. 7, the values entered would be as follows:

TABLE 2

| Variable | Value |
|---|---|
| NumHoppers | 4 |
| NumScanners | 2 |
| FirstHopper | 1 (True or "Y") |
| LocScanners | 1011 (binary) |

Controller unit 52 verifies whether the first hopper is active as designated by an alphanumeric symbol "Y" (step 210) designated by the value contained in the LocScanners variable. If the first hopper is active, controller unit 52 verifies whether there is a scanner at that hopper (step 212). Typically, the value entered by the operator as to the location of the scanners is a Boolean mask value (for example "1011" represents scanners 58 at stacks 23*a*, 23*c* and 23*d*) for comparison purposes, else, the program continues to the next hopper (step 224) and decrements the value stored in the HopperCnt variable. If there is a scanner 58 at the next hopper 20, then scanner code 88 on insert 22 is read by scanner 58.

The software program executed on controller unit 52 determines whether the code 104 read is a sort code value 130 or verifies a subsequent scanner code value 138 against the verification value 138 stored in table 132 according to a specific job set 134 shown in FIG. 8. Table 132 is stored in random access memory in the microprocessor circuit of the controller 32. For operator purposes, the alphanumeric "Y" or "N" is displayed in the table. However, with respect to standard programming practices, a "Y" representing "TRUE" is any value other than a numeric "ZERO". For example, a verification value of "67" in hopper 2 of sort code value 28 indicates "TRUE." "ZERO" indicates "N" or "FALSE". Therefore, the subsequent code values 138 read from stacks 23*b*, 23*c*, or 23*d*, are verified against the values stored in a job set 134 of table 132 (step 216). If the code 88 is a sort code value or verifies against the values contained in table 132, insert machine 10, shown in FIG. 1, mechanically places an insert 22 from the next designated stack onto job stack 123 (step 222). Alternatively, if the scanner code 88 on the insert 22 of the stack being verified is not a sort code value 130 nor does it verify against the values stored in table 132 for that job set 134, then insert machine 10 is halted (step 218). Typically, a verification error will occur when the operator has misplaced a stack of inserts in the wrong hopper. Alarms or other signals are activated such that the operator can correct the error, after which, the insert job can proceed.

With respect to the example provided, the verification process is repeated at each designated stack as set out by the job set 134 of table 132 shown in FIG. 8. When halted, insert machine 10 grasps insert 22 such that the operator can easily remove the insert and replace it with a valid insert 22 according to the sort code 104 entered at the beginning of the process. Once the error is fixed (step 220), the operator presses a continue job button 76, shown in FIG. 2, and the insert job continues until the end is reached (step 230). The end of the job is designated when the first stack 23*a* is depleted.

The description and figures of the specific examples above do not point out what an infringement of this invention would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

Having described the invention, what is claimed is:

1. An automation and verification device for an insert machine having at least a first and a second electronically selectable hopper, each having a stack of inserts encoded with an electronically readable sort code and having at least one insert with an exposed sort code, the automation and verification device comprising:

a controller unit having a microprocessor and an electronic memory circuit, said controller unit being electrically connected to the plurality of electronically selectable hoppers;

a first code scanner mounted on the insert machine such that said first code scanner is oriented to read the exposed sort code of the insert of the first hopper of the plurality of hoppers;

a second code scanner mounted on the insert machine such that said second code scanner is oriented to read the sort code of the insert of the second hopper, said first and said second code scanners electrically connected to said controller unit; and a program executed on the microprocessor of said controller unit to select at least one hopper of the electronically selectable hoppers responsive to the sort code of the insert of the first hopper and to verify the computer readable code of the insert of the second hopper with a verification value stored in a table located in the electronic memory circuit.

2. The automation and verification device of claim 1 wherein each of said code scanners is mounted to the insert machine with a placement arm.

3. The automation and verification device of claim 2 wherein said placement arm comprises:

a first elongated member;

a second elongated member;

a pivot mount having a first portion and a second portion, said first portion defining a first aperture adapted to accept said first elongated member and said second portion defining a second aperture adapted to accept said second elongated member, the first portion and the second portion rotatably displaceable along a common axis; and securing means for compressing the first portion and the second portion of said pivot mount into a frictional relation with each other and with said first and said second elongated members.

4. The automation and verification device of claim 1 wherein said first and said second code scanners are laser diode scanners.

5. The automation and verification device of claim 1 wherein said controller unit comprises:

a microprocessor circuit having an electronic memory, a digital output port, a digital input port, and a serial communications port; and a scanner decoder electrically connected the serial communications port of said microprocessor.

6. The automation and verification device of claim 5 wherein said controller unit further comprises:

a video display monitor electrically connected to said microprocessor circuit.

7. The automation and verification device of claim 1 further comprising:

a hopper selector interface circuit electrically connected to said controller unit and electrically connected to the plurality of selectable hoppers.

8. The automation and verification device of claim 7 wherein said hopper selector interface circuit is a plurality of relays.

9. The automation and verification device of claim 7 wherein said hopper selector interface circuit is a digital multiplexer circuit.

10. The automation and verification device of claim 1 wherein said program halts the insert machine when the computer readable code of the insert of the second hopper does not verify with the computer readable code of the insert of the first hopper.

11. A combination comprising:

an insert machine having a plurality of electronically selectable hoppers, at least a first and a second electronically selectable hopper having an insert with a computer readable code and having at least one exposed computer readable code;

a first laser scanner mounted on said insert machine such that said first code scanner is oriented to read the computer readable code of the insert of the first hopper;

a second laser scanner mounted on said insert machine such that said second code scanner is oriented to read the computer readable code of the insert of the second hopper, said first and said second code scanners electrically connected to said controller unit;

a controller unit comprising:

a microprocessor circuit having an output port electrically connected to the plurality of electronically selectable hoppers;

a scanner decoder electrically connected to said first and said second laser scanners; and a program executed on the microprocessor circuit of said controller unit to select at least one hopper of the plurality of electronically selectable hoppers responsive to the computer readable code of the insert of the first hopper and to verify the computer readable code of the insert of the second hopper with a verification value stored in a table located in the electronic memory circuit, said program halting said insert machine when the computer readable code of the insert of the second hopper does not verify against the verification value.

12. The combination of claim 11 wherein said microprocessor circuit further comprises an input port electrically connected to a control panel of said insert machine.

13. A method of automating an insert job comprising the steps of:

(a) providing an insert stack set having at least a first stack with a first plurality of inserts and a second stack with a second plurality of inserts, said first stack having an first electronically readable key code encoded on each insert of said first plurality of inserts wherein said key code has at least a first sort code value or a second sort code value;

(b) scanning said first key code of a first insert of said first plurality of inserts of said first stack;

(c) determining with a program executed on a microprocessor whether said first key code has either said first sort code value or said second sort code value;

(d) designating from said insert stack set a predetermined job set according to whether said first key code has said first sort code value or said second sort code value with an electronic selection circuit controllable by said program executed on said microprocessor; and (e) forming a job stack formed by an insert from each stack of said predetermined job set.

14. The method of automating an insert job of claim 13 further comprising the step of:

(f) inserting said job stack into a mailing envelope.

15. The method of automating an insert job of claim 13 further comprising the steps of:

repeating steps (b) through (e) until said first stack with a first plurality of inserts is depleted.

16. The method of automating an insert job of claim 13 wherein said second stack with a second plurality of inserts has a second electronically readable key code having a third code value encoded on each insert of said second plurality of inserts.

17. The method of automating an insert job of claim 16 further comprising the steps of:

(f) scanning said second key code of a first insert of said first plurality of inserts of said second stack when said second stack is a member of said predetermined job set;

(g) comparing with said program executed on said microprocessor said third code value of said second key code with a verification value contained in said job set with said first key code; and (h) announcing an error when said second key does not equal said first key code.

18. The method of automating an insert job of claim 17 further comprising the steps of:

repeating steps (b) through (h) until said first stack with a first plurality of inserts is depleted.

19. The method of automating an insert job of claim 13 wherein the step of electronically reading said first key code is performed with a laser diode scanner.

* * * * *

UNITED STATES PATENT AND TRADEMARK OFFICE

CERTIFICATE OF CORRECTION

PATENT NO. : 5,730,299

DATED : March 24, 1998

INVENTOR(S) : Thomas H. Helsley

It is certified that error appears in the above-identified patent and that said Letters Patent is hereby corrected as shown below:

In Column 3, line 43, after "panel" insert –30--.

In Column 3, line 67, after "line" insert --74--.

Signed and Sealed this

Sixth Day of October, 1998

*Attest:*

*Attesting Officer*

Bruce Lehman

BRUCE LEHMAN

*Commissioner of Patents and Trademarks*